United States Patent [19]

Carson

[11] 3,951,087

[45] Apr. 20, 1976

[54] BOAT DRY DOCKING APPARATUS

[76] Inventor: Bobbie D. Carson, 2300 S. Gessner No. 202, Houston, Tex. 77042

[22] Filed: May 2, 1975

[21] Appl. No.: 573,976

[52] U.S. Cl. ..... 114/45; 61/65; 214/1 A

[51] Int. Cl.[2] ..... B63C 1/6

[58] Field of Search ..... 114/45–48, 114/.5 BD; 61/64, 65, 66, 67; 214/1 A

[56] References Cited

UNITED STATES PATENTS

| | | | |
|---|---|---|---|
| 3,270,698 | 9/1966 | Fort | 114/45 |
| 3,362,172 | 1/1968 | Rutter | 61/65 |
| 3,603,276 | 9/1971 | Delisle | 114/45 |
| 3,727,415 | 4/1973 | Williams | 61/65 |
| 3,857,248 | 12/1974 | Rutter | 61/65 |
| R 27,090 | 3/1971 | Rutter | 61/65 |

*Primary Examiner*—Trygve M. Blix
*Assistant Examiner*—Stuart M. Goldstein
*Attorney, Agent, or Firm*—C. Clark Dougherty, Jr.

[57] ABSTRACT

The present invention relates to a boat dry docking apparatus for installation in a boat dock having substantially parallel sides. An elongated frame is provided adapted to be disposed horizontally in the boat dock and a boat supporting cradle and flotation tank are mounted on the frame. A pair of spaced apart arm members are pivotally attached at the lower ends thereof to each side of the frame and bolts are connected to the upper ends of the arm members for pivotally connecting the upper ends to the sides of the boat dock. The arm members are of a length such that when the bolts for pivotally connecting the upper ends thereof to the dock are attached to the dock in a manner whereby the upper pivotal connections of the arm members are positioned substantially vertically above the lower pivotal connections to the frame, the frame is free to swing between a lower horizontal position beneath the water level in the boat dock whereby a floating boat can be positioned above the boat cradle and an upper horizontal position whereby the boat cradle is above the water level. An air blower and connecting conduit for selectively filling the flotation tank with air are provided to raise the frame to the upper position or exhausting air therefrom to lower the frame to the lower position.

6 Claims, 4 Drawing Figures

BOAT DRY DOCKING APPARATUS

BACKGROUND OF THE INVENTION

1. Field of the Invention

The present invention relates generally to boat dry docking apparatus, and more particularly, but not by way of limitation, to a boat dry docking apparatus for installation in an individual boat dock which is raised and lowered by selectively introducing or exhausting air from a flotation tank attached thereto.

2. Description of the Prior Art

Many various boat dry docking apparatus have been developed and used heretofore. Recently, boat dry docking apparatus for installation in individual small boat wells or docks have been developed. Typically, such dry docking apparatus are comprised of a frame pivotally attached to the boat dock with a boat supporting cradle mounted on top of the frame. A flotation tank is attached to the lower side of the frame and air is introduced into the flotation tank to raise the frame so that the boat supporting cradle is lifted above the level of water in the boat dock, or air is exhausted from the flotation tank so that the frame and boat supporting cradle are lowered below the level of water a distance sufficient to allow the free passage of a boat to and from the boat dock.

Prior to the present invention, boat dry docking apparatus of the type described above have been relatively complex and expensive, and have been pivotally attached to the boat docks at the forward ends thereof with the rearward ends being submerged in the water or raised therein by means of the flotation tank. That is, when in the upper raised position, the frame and boat cradle of prior apparatus are positioned substantially horizontally, but when in the lowered submerged position only the rearward end of the frame and boat supporting cradle are lowered so that the boat supporting cradle is positioned at a steep angle. This makes the positioning of a boat to be dry docked and the lifting thereof difficult. In addition, due to the complexity of such boat dry docking apparatus, they generally must be shipped in an assembled condition and are difficult to install in a boat dock.

By the present invention a boat dry docking apparatus for installation in a boat dock is provided which is simple and economical, which can be shipped in a disassembled condition without the flotation tank and which can be readily assembled at the boat dock site by the owner thereof, using one or more standard cattle watering tanks as flotation tanks. In addition, the frame and boat supporting cradle of the present invention are maintained in a horizontal position both when submerged and when raised.

SUMMARY OF THE INVENTION

The present invention relates to a boat dry docking apparatus for installation in a boat dock having substantially parallel sides comprised of an elongated frame adapted to be disposed horizontally in the boat dock having a boat supporting cradle mounted thereon. A flotation tank is attached to the frame, and a pair of spaced apart arm members are pivotally attached at the lower ends thereof to each side of the frame. Means are connected to the upper ends of the arm members for pivotally attaching the upper ends to the sides of the boat dock. The arm members are of a length such that when the means for pivotally attaching the upper ends thereof to the boat dock are attached to the boat dock in a manner whereby the upper pivotal connections of the arm members are positioned substantially vertically above the lower pivotal connections thereof to the frame, the frame is free to swing between a lower horizontal position beneath the water level in the boat dock so that a floating boat can be positioned above the boat cradle and an upper horizontal position whereby the boat cradle is above the water level. Means are provided for selectively filling the flotation tank with air to raise the frame to the upper position or exhausting air therefrom to lower the frame to the lower position.

It is, therefore, a general object of the present invention to provide an improved boat dry docking apparatus.

A further object of the present invention is the provision of a boat dry docking apparatus for installation in an individual boat dock which is simple and economical as compared to prior art boat dry docking apparatus.

Yet a further object of the present invention is the provision of a boat dry docking apparatus which can be shipped in a disassembled condition without the flotation tank and readily assembled by the owner at the boat dock site using standard cattle watering tanks as the flotation tanks.

Still a further object of the present invention is the provision of a boat dry docking apparatus for installation in a boat dock whereby the boat supporting cradle is maintained in a horizontal position both in the raised and submerged positions.

Other and further objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

Figure 1:
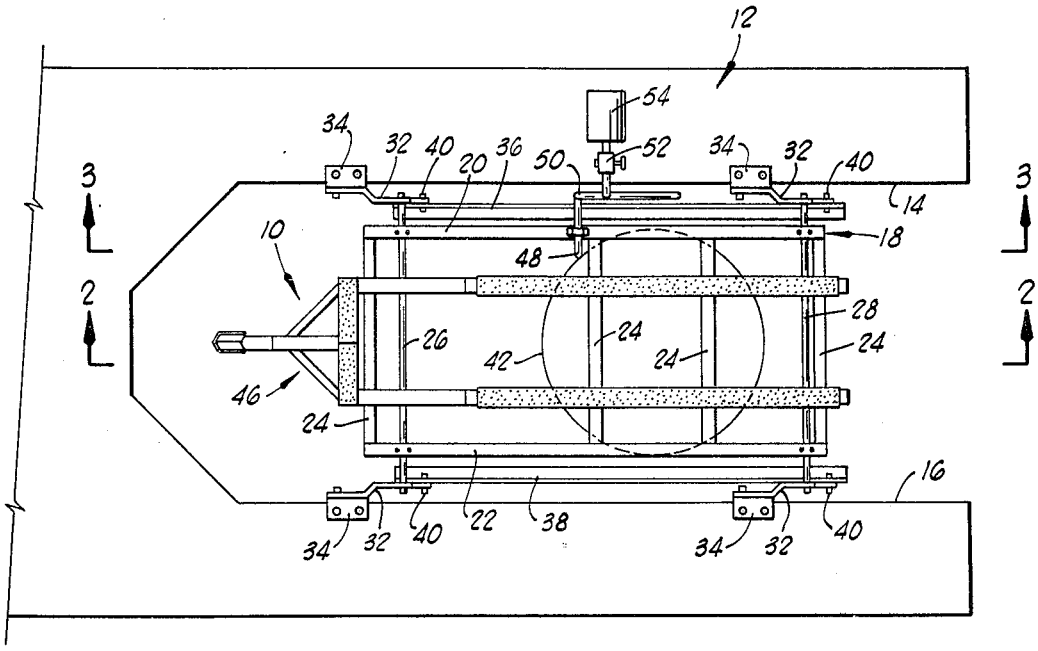
FIG. 1 is a top plan view of an individual boat dock with the boat dry docking apparatus of the present invention installed therein.
Figure 2:
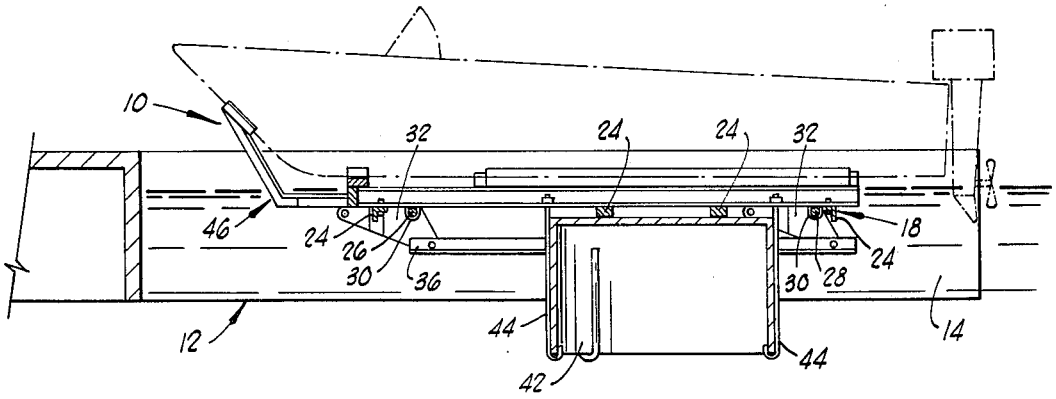
FIG. 2 is a cross-sectional view taken along line 2—2 of FIG. 1.

Referring now to the drawings, the boat dry docking apparatus of the present invention is illustrated and generally designated by the numeral 10. As best shown in FIGS. 1 and 2, the apparatus 10 is adapted to be installed in a boat dock 12 having substantially parallel sides 14 and 16. As will be understood, the boat dock 12 is of the floating type and is positioned in the water so that a floating boat can be readily maneuvered into and out of the dock between the sides 14 and 16.

The apparatus 10 basically comprises an elongated frame 18 having substantially parallel sides 20 and 22, and adapted to be positioned horizontally between the sides 14 and 16 of the boat dock 12. The sides 20 and 22 of the frame 18 are connected together by a plurality of cross members 24. For ease of assembly, the sides 20 and 22 and cross members 24 are preferably formed of flat iron and angle iron and are bolted together.

Two pieces of pipe 26 and 28, positioned transversely with respect to the sides 20 and 22 of the frame 18, are attached to the frame 18 adjacent the forward and rearward ends thereof, respectively. For convenience of assembly, the pipes 26 and 28 are preferably bolted to the sides 20 and 22 of the frame 18 by conventional U-bolts 30. The pipes 26 and 28 extend outwardly from the sides 20 and 22 of the frame 18 equal distances and are pivotally connected to arm members 32.

The arm members 32 are preferably of the same size and are generally triangular in shape. The ends of the bars 26 and 28 are pivotally connected to the lower ends of the arm members 32 in a conventional manner. For example, each of the arm members 32 can include a pipe sleeve welded thereto for receiving the ends of the pipes 26 and 28. The ends of the pipes 26 and 28 can pivot within the pipe sleeves or can be rigidly connected to the pipe sleeves such as by bolts with the pipes 26 and 28 being allowed to pivot within the U-bolts 30 attached to the frame 18. Each of the upper ends of the arm members 32 are pivotally connected by means of a bolt to a bracket member 34 adapted to be attached to a side of the boat dock 12. The bracket members 34 are preferably formed of flat iron and are bent at right angles so that they can be bolted or otherwise rigidly attached to both the top and sides of the boat dock 12.

A pair of angle or channel structural members 36 and 38 are positioned below and parallel to the sides 20 and 22 of the frame 18 and are each pivotally attached to a pair of the arm members 32 at the lower ends thereof such as by means of bolts 40. For reasons which will be described further hereinbelow, the pivotal connections of the channels 36 and 38 to the arm members 32 are positioned below and horizontally offset from the connections of the pipes 26 and 28 thereto. That is, the pivotal connections of the arm members 32 to the channels 36 and 38 are horizontally offset from the connections of the bars 26 and 28 thereto a short distance opposite to the desired direction of swing of the frame 18. Preferably, each of the connections of each of the arm members 32, i.e., the pivotal connection to a bracket 34, the connection to an end of a pipe 26 or 28 and the pivotal connection to a channel 36 or 38, are each positioned adjacent a different corner thereof.

A flotation tank 42 is rigidly attached to the bottom of the frame 18. While the flotation tank 42 can take a variety of forms, it is preferably cylindrical in shape with a closed top and an open bottom. Most conveniently, the flotation tank is a conventional galvanized livestock watering trough which is inverted and rigidly attached to the bottom of the frame 18. Such standard cattle watering tanks can be purchased at most farm supply stores throughout the United States. As shown in FIG. 2, a plurality of J-bolts 44 can be used for attaching the flotation tank 42 to the frame 18.

A conventional boat supporting cradle 46 is bolted to the top of the frame 18 for supporting a boat above the frame 18 as illustrated in FIG. 2. As will be understood by those skilled in the art, the boat supporting cradle 46 can take a variety of forms and can be formed of wood or metal with padding positioned thereon to prevent damage to the hull of a boat dry docked on the apparatus 10.

A U-shaped conduit 48 which is preferably formed of metal or plastic is bolted to the frame 18 with one end positioned within the interior of the flotation tank 42 extending to a point adjacent the top thereof. A flexible hose 50 is sealingly attached to the other end of the conduit 48 and to a conventional three-way valve 52 which is in turn connected to the air discharge of a conventional electric-operated air blower 54. The three-way valve 52 is of a type which can be positioned to connect the discharge of the blower 54 to the hose 50, to shut off the hose 50 or to open the hose 50 to the atmosphere.

Operation

Figure 3:
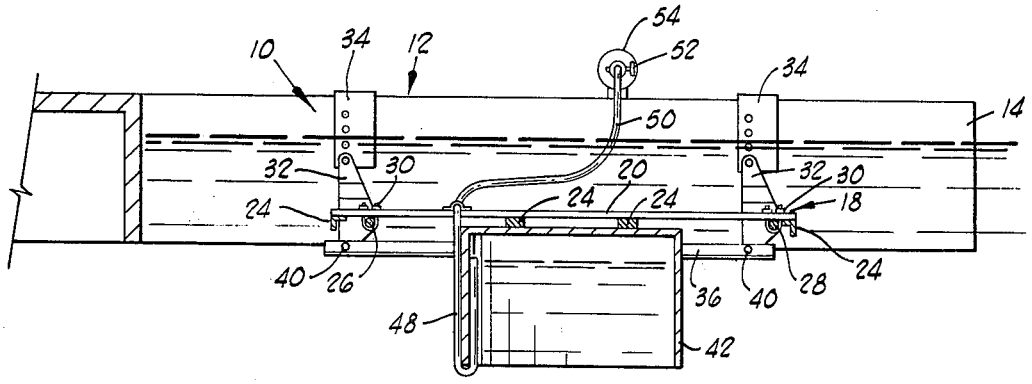
FIG. 3 is a cross-sectional view taken along line 3—3 of FIG. 1.
Figure 4:
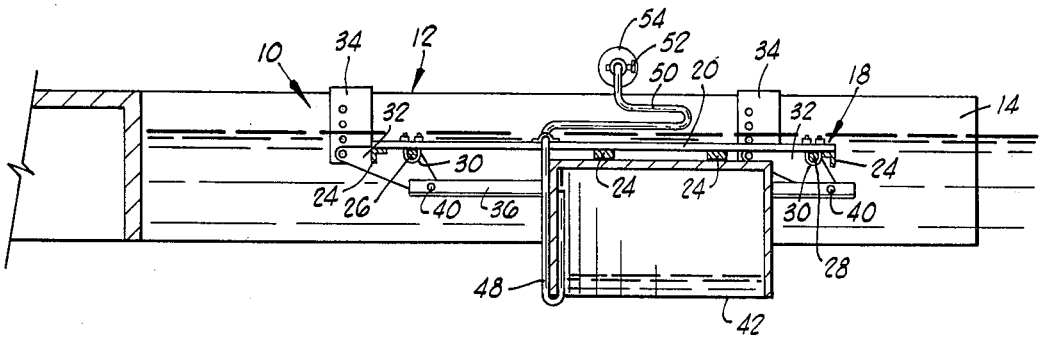
FIG. 4 is a cross-sectional view similar to FIG. 3 but illustrating the apparatus in the upper raised position.

In operation of the apparatus 10, the three-way valve 52 is manually operated to open the hose 50 to the atmosphere which causes air contained within the flotation tank 42 to be exhausted therefrom. This in turn causes the apparatus 10 to submerge below the level of water in the boat dock 12 to the position shown in FIG. 3.

The pivotal connections of the channels 36 and 38 to the arm members 32 are positioned with respect to the connections of the pipes 26 and 28 to the arm members 32 such that when the frame 18 reaches the lower submerged position the pipes 26 and 28 are contacted by the members 36 and 38 and the frame 18 is prevented from swinging to the point where the connections of the pipes 26 and 28 to the members 32 are vertically below the pivotal connections of the members 32 to the brackets 34. Stated another way, the members 36 and 38 function to maintain the connections of the frame 18 to the members 32 horizontally offset a short distance in the desired direction of swing of the frame 18 from the pivotal connections of the members 32 to the brackets 34. This insures that when the flotation tank 42 is filled with air and caused to raise the frame 18, the frame 18 swings in the desired direction and not in the opposite direction.

In a preferred embodiment as best shown in FIG. 1, the channels 36 and 38 are positioned below the ends of the pipes 26 and 28 which extend outwardly from the sides 20 and 22 of the frame 18. In this arrangement, when the frame 18 is lowered to its lower position beneath the surface of the water in the boat dock 12, the channels 36 and 38 contact the pipes 26 and 28 to stop the swing of the frame 18 at the desired position. However, as will be understood, the channels 26 and 28 can be positioned above or below the frame 18 to contact the sides thereof or a variety of other arrangements can be utilized to stop the swing of the frame 18 at a position whereby upon being raised it will swing in the desired direction.

When it is desired to dry dock a boat using the apparatus 10, the boat is maneuvered above the apparatus 10 so that the boat supporting cradle 46 is positioned below the boat hull. The air blower 54 is started and the valve 52 positioned so that air flows from the discharge of the blower 54 through the hose 50, through the conduit 48 and into the flotation tank 42. As the tank 42 fills with air, water is displaced therefrom and the tank is buoyed up so that the frame 18 is raised by swinging on the arm members 32 to the upper position whereby the boat is supported on the boat supporting cradle 46 above the level of water in the boat dock 12 as shown in FIG. 2. Because the arm members 32 are of the same size and shape, as the frame 18 and the boat supporting cradle 46 are moved from the lower submerged position to the upper raised position, the frame 18 and cradle 46 are maintained in a horizontal position thereby making the dry docking of the boat and the return of the boat into the water readily and easily accomplished.

Thus, the present invention is well adapted to carry out the objects and attain the ends and advantages mentioned as well as those inherent therein. While numerous changes in the construction and arrangement of parts will readily suggest themselves to those skilled in the art, such changes are encompassed within the spirit of this invention as defined by the appended claims.

What is claimed is:

1. Boat dry docking apparatus for installation in a boat dock having substantially parallel sides comprising:

an elongated frame adapted to be disposed horizontally in said boat dock;

a boat supporting cradle mounted on said frame;

a flotation tank attached to said frame;

a pair of spaced apart arm members pivotally attached at the lower ends thereof to each side of said frame, said arm members being of substantially equal lengths;

means connected to the upper ends of said arm members for pivotally attaching the upper ends thereof to the sides of said boat dock;

said arm members being of a length such that when said means for pivotally attaching the upper ends thereof to said boat dock are attached to said dock in a manner whereby the upper pivotal connections of said arm members are positioned substantially vertically above the lower pivotal connections thereof to said frame, said frame is free to swing between a lower horizontal position beneath the water level in said boat dock so that a floating boat can be positioned above said boat cradle, and an upper horizontal position whereby said boat cradle is above said water level; and means for selectively filling said flotation tank with air to raise said frame to said upper position or exhausting air therefrom to lower said frame to said lower position.

2. The apparatus of claim 1 wherein said flotation tank has an open bottom.

3. The apparatus of claim 2 wherein said flotation tank is an inverted galvanized livestock watering trough.

4. The apparatus of claim 1 which is further characterized to include means attached to said arm members for maintaining the lower connections thereof to said frame when said frame is in said lower position horizontally offset a distance in the desired direction of swing from the upper pivotal connections thereof to said dock so that when said frame is raised by filling said flotation tank with air said frame swings in the desired direction.

5. The apparatus of claim 4 wherein said means attached to said arm members for maintaining the lower connections thereof horizontally offset from the upper pivotal connections thereof when said frame is in said lower position comprises:

a pair of elongated structural members each of which is positioned below and parallel to a side of said frame, each of said structural members being pivotally connected to a pair of said arm members at points offset a horizontal distance from the connections of said arm members to said frame so that when said frame is in said lower position, said structural members contact said frame and stop the swing thereof whereby said connections of said arm members to said frame are horizontally offset from the upper pivotal connections of said arm members to said dock.

6. The apparatus of claim 5 wherein each of said arm members is triangular in shape and the connections thereof to a side of said dock, to said frame and to one of said structural members are each positioned in a different corner thereof.

* * * * *